United States Patent [19]

Crossfield

[11] Patent Number: 5,049,856

[45] Date of Patent: Sep. 17, 1991

[54] ANTIPILFERAGE SYSTEMS

[75] Inventor: Michael D. Crossfield, Brackley, United Kingdom

[73] Assignee: Scientific Generics Limited, Cambridge, United Kingdom

[21] Appl. No.: 445,765

[22] Filed: Dec. 4, 1989

[30] Foreign Application Priority Data

Apr. 15, 1988 [GB] United Kingdom ..... 8808933

[51] Int. Cl.[5] ..... G08B 13/24; H01Q 1/36

[52] U.S. Cl. ..... 340/551; 340/505; 340/572; 343/895

[58] Field of Search ..... 340/551, 572, 505, 825.54; 324/260, 228, 243; 343/895; 361/402; 29/846

[56] References Cited

U.S. PATENT DOCUMENTS

| | | | |
|---|---|---|---|
| 4,135,183 | 1/1979 | Heltemes . | |
| 4,263,553 | 4/1981 | Cook et al. . | |
| 4,305,785 | 12/1981 | Praeg | 324/260 X |
| 4,482,874 | 11/1984 | Rubertus et al. . | |
| 4,532,620 | 7/1985 | Matsuda et al. | 361/402 X |
| 4,541,559 | 9/1985 | O'Brien . | |
| 4,578,654 | 3/1986 | Tait . | |
| 4,583,099 | 4/1986 | Reilly et al. . | |
| 4,598,276 | 7/1986 | Tait . | |
| 4,605,898 | 8/1986 | Aittoniemi et al. | 340/551 X |
| 4,613,843 | 9/1986 | Esper et al. . | |
| 4,618,822 | 10/1986 | Hansen | 340/572 X |
| 4,623,877 | 11/1986 | Buckens . | |
| 4,633,250 | 12/1986 | Anderson, III et al. . | |
| 4,647,917 | 3/1987 | Anderson, III et al. | 340/572 |
| 4,658,241 | 4/1987 | Torre | 340/551 |
| 4,769,631 | 9/1988 | Copeland | 340/55 T |
| 4,791,412 | 12/1988 | Brooks | 340/572 |
| 4,795,995 | 1/1989 | Eccleston et al. | 340/551 X |
| 4,837,568 | 6/1989 | Snaper | 340/825.54 |
| 4,866,424 | 9/1989 | Parks | 340/551 |

FOREIGN PATENT DOCUMENTS

| | | |
|---|---|---|
| 441221 | 9/1969 | Australia . |
| 451179 | 6/1973 | Australia . |

*Primary Examiner*—Glen R. Swann, III
*Assistant Examiner*—Thomas J. Mullen, Jr.
*Attorney, Agent, or Firm*—Sixbey, Friedman, Leedom & Ferguson

[57] ABSTRACT

An antipilferage system for the detection of magnetic tags comprises an assembly (2) of spirally wound emitter (1) and/or detector (3*a*, 3*b*) coils. This arrangement enables a tag to be detected regardless of its orientation.

5 Claims, 4 Drawing Sheets

ANTIPILFERAGE SYSTEMS

This is a continuation of PCT/GB89/00164 filed Feb. 20, 1989 which in turn is based upon G.B. patent application no. 8808933.9 filed Apr. 15, 1988.

BACKGROUND OF THE INVENTION

This invention relates to antipilferage systems and to devices for use therein.

Antipilferage tags or markers are applied to articles of commerce in order to protect them from theft at the point of sale premises. Typically, the tag is a magnetic medium is deactivated when a shop assistant carries out the routine procedure at the time of effecting a sale. Such deactivation prevents detection of the magnetic tag when it (and the article to which it is attached) pass through a detection system, typically in the form of a walk-through framework which emits an alternating magnetic interrogation field. This field is designed to interact with a tag and to respond by, for example, emitting a warning signal in the event that detection of a non-deactivated tag occurs.

A problem which occurs frequently with conventional antipilferage systems is that an adequate detection signal is only available if a non-deactivated tag passes through the interrogation gate in the correct orientation. Normal interrogating gates contain coils which generate a magnetic field principally along the axis of the coil. The magnetic tags are also usually unidirectionally sensitive. Thus generally, the major axis of the tag needs to be aligned perpendicularly with respect to plane of the coils (i.e. along the coil axis) which produce the interrogating field if the tag is to be detected. Consequently, it is by no means unusual for the antipilferage system to fail to detect certain items which are removed from the store without first having gone through the proper sales procedure simply because of the orientation of the tag on the article as it is moved through the interrogating field.

Disclosure of the Invention

We have now devised an alternative to the usual interrogating gate system as employed at or near the point of sale in stores. The principal element of this alternative system can be constructed as a walk-through framework, or as a hand-held item, the net response of which which is not orientation-dependent. More particularly, according to one aspect of the present invention, there is provided an interrogating system for use in an antipilferage system, which is characterised in that the interrogating system comprises a magnetic field generator which is in the form of a substantially planar spirally wound coil or of a coil which is wound so as to approximate to a spiral. The system preferably also includes means for detecting the response of a magnetic tag positioned within the effective field generated by said magnetic field generator, said detection means comprising one or more pairs of coils wound spirally or wound so as to approximate to a spiral winding, and positioned so as to overlay the magnetic field generator coil. Such overlay should preferably be exactly symmetrical and the phasing of the windings such that the net signal coupled directly from the field generator coil is near to zero. This arrangement greatly simplifies the filtering normally required at the receiver input to prevent overloading by directly coupled signals. It also enables the overall sensitivity to be tailored such that it is similar for labels in any orientation.

Preferably, the magnetic field generator coil and/or the detection coils are formed by photolithographic techniques such as are used in the production of printed circuit boards. The use of these techniques allows very precise mutual orientation between the emitting coil (on one side of the card or device) and the detecting coils (on the other side of the card or device). An arrangement of generator coil and detection coils is hereinafter referred to as a coil assembly.

The whole system is preferably constructed as an array of such coil assemblies which, in use, is positioned close to a point of sale such that customers and/or items to be checked will pass close to the array. Alternatively, a hand-held unit based on a single coil assembly (magnetic field generator coil and detection coils) is moved over the person to locate any concealed items carrying non-deactivated tags.

As used herein, the term "spiral" is not restricted to circular spirals, but also encompasses within its scope square, rectangular, oval and other simple spiral arrangements as well as more complicated shapes, provided that there is substantial adjacency in a common plane successive turns or courses of the winding.

One particular advantage of a flat spiral coil configuration in accordance with this invention over a conventional pile-wound coil of constant radius is its ease of automated manufacture. Another important advantage is that there is an improved magnetic field pattern. In particular, there is much less curvature of the principal component of the field pattern in the area immediately above the windings. This improves the maximum coupling possible between the coils and a magnetic label in the vicinity of the coils. Since the overall sensitivity pattern of a generator/detector coil pair depends on their mutual arrangement, it is easy to arrange the areas and the overlaps of the two spiral windings to produce similar sensitivities for magnetic labels in any orientation.

With a detection device in accordance with this invention, a magnetic tag which has not been deactivated will give a response regardless of its orientation with respect to the device, at least at one point in a plane parallel to the surface of the spiral. It is thus possible to configure adjacent rows of suitably dimensioned coil assemblies such that a tag in any orientation which moves in a plane parallel to the array will be detected at some point(s) in its travel over the plane.

In those embodiments of the invention which take the form of a hand-held device, a single coil assembly will detect a tag in any orientation if it is scanned in a suitable fashion in a plane parallel to that in which the tag lies. A suitable scan would be a simple meander with dimensions of the same order as the coil dimensions.

BRIEF DESCRIPTION OF THE DRAWINGS

An exemplary embodiment of the present invention is shown in the accompanying drawings, in which.

DETAILED DESCRIPTION OF THE PREFERRED EMBODIMENTS

Figure 1:
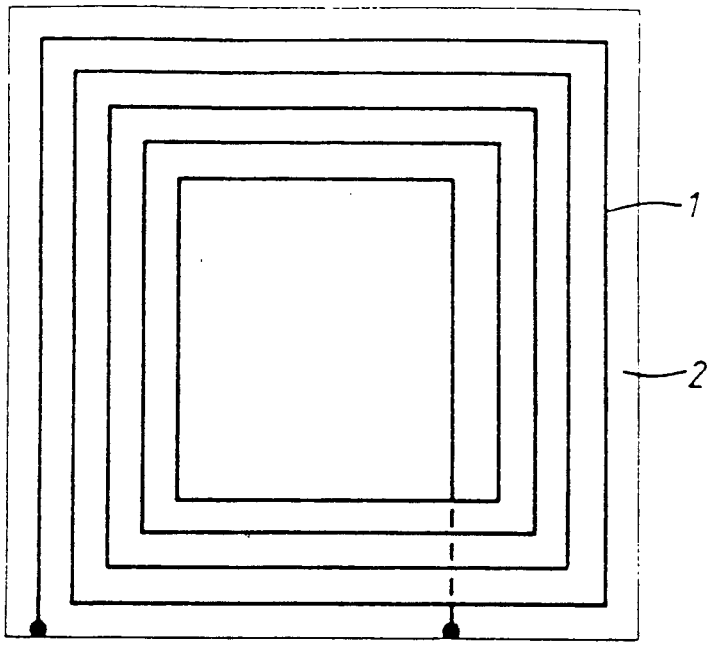
FIG. 1 is a plan view of a spirally wound emitter coil.

In the preferred embodiment each coil assembly comprises a generator coil 1 as shown in FIG. 1 which is formed by photolithographic techniques as a planar spiral on a card 2 and two detector coils 3*a*, 3*b* arranged on the other side of the card 2 so as to overlay the generator coil 1. Each detector coil is similarly formed as a spriral.

Figure 3:
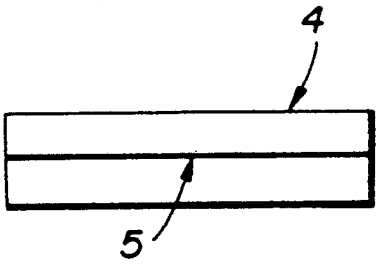
FIG. 3 is a diagrammatic side view of a typical label used to trigger the interrograting system.
Figure 4A:
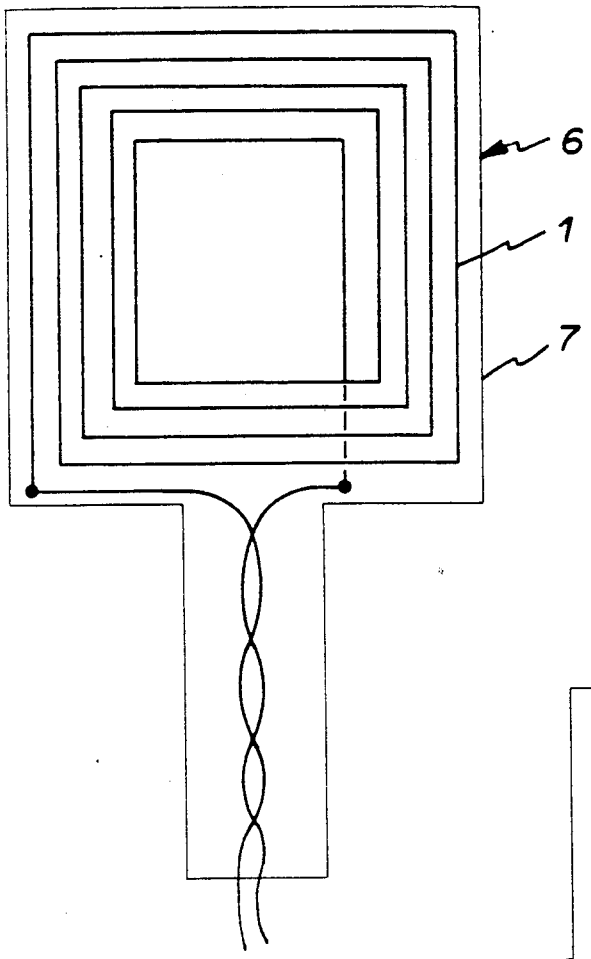
FIGS. 4A and 4B are opposite digrammatic side views illustrating the handheld detector embodiment.
Figure 4B:
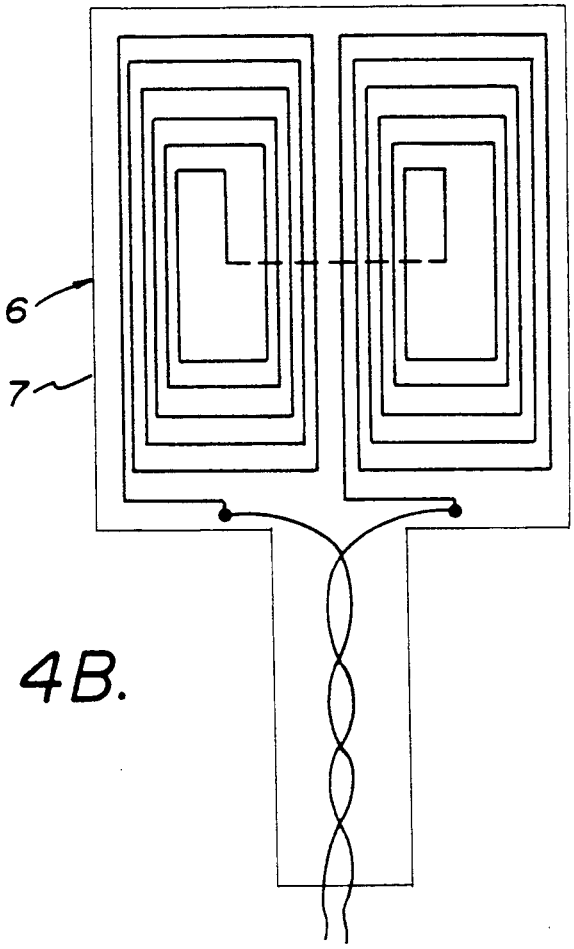

One particular type of EAS label 4 (FIG. 3) utilises a strip 5 of amorphus ferromagnetic alloy about 30 cm long. For a hand-held detector 6 application (see FIGS. 4A and 4B) a coil assembly with a total dimension of 160 mm×160 mm×1 mm thick, with about 30 turns in the emitting coil; and 2×60 turns in the detecting coil 3*a* and 3*b* has been fabricated from double sided copper-clad fibre-glass printed cicruit board 7. Using a processing system based on detection of high-order harmonics of a low level 5 KHz interrogating field, and simple band-pass filtering, detection of labels in all orientations at a maximum distance of 100±10 mm has been demonstrated.

Figure 2:
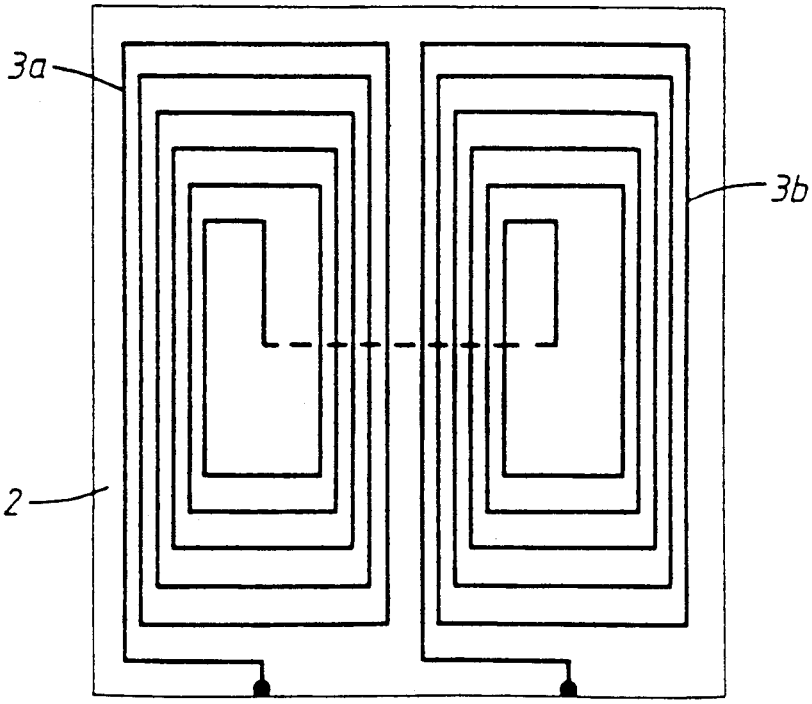
FIG. 2 is a plan view of spirally wound detector coils.
Figure 6:
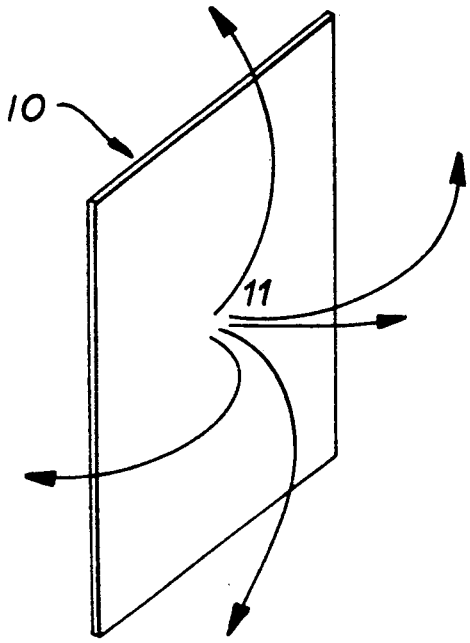
FIG. 6 is a diagrammatic view illustrating a magnetic field emanating from the plane of the coil assembly.
Figure 5:
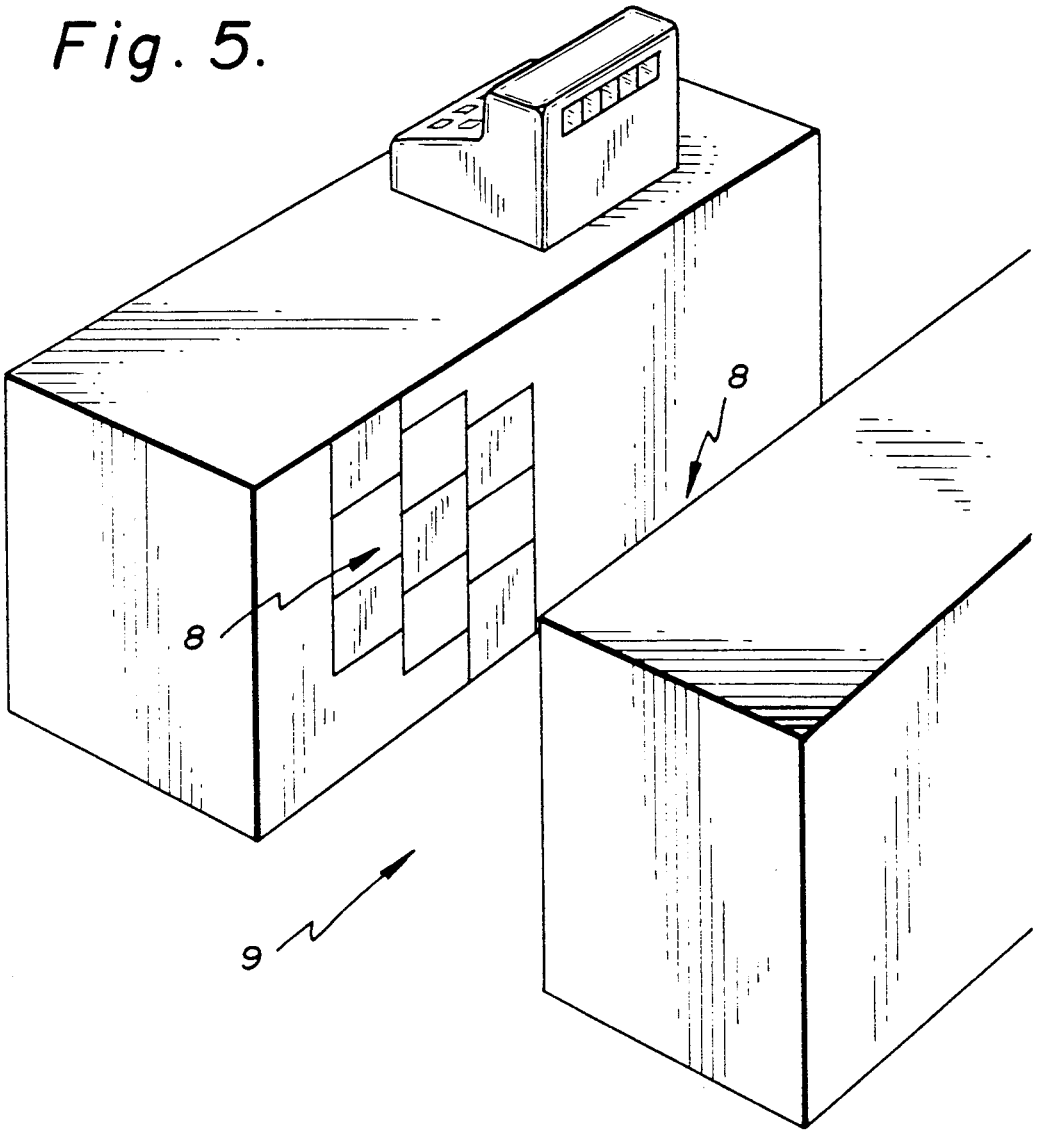
FIG. 5 is a schematic pictoral view of the point of sale detector embodiment.

Alternatively, the interrogation gate system can be integrated into a point of sale location as shown in FIG. 5. In this embodiment, an array of coil assemblies 8 of the type shown in FIGS. 1 and 2 is provided on opposite sides of a check-out path 9.

FIG. 9 depicts schematically the directions of the magnetic field which emanate from the generator coil 1. The magnetic field (designated by arrows 11) emanate in a symmetrical fashion from the plane 10 of the generator coil 1.

Figure 7:
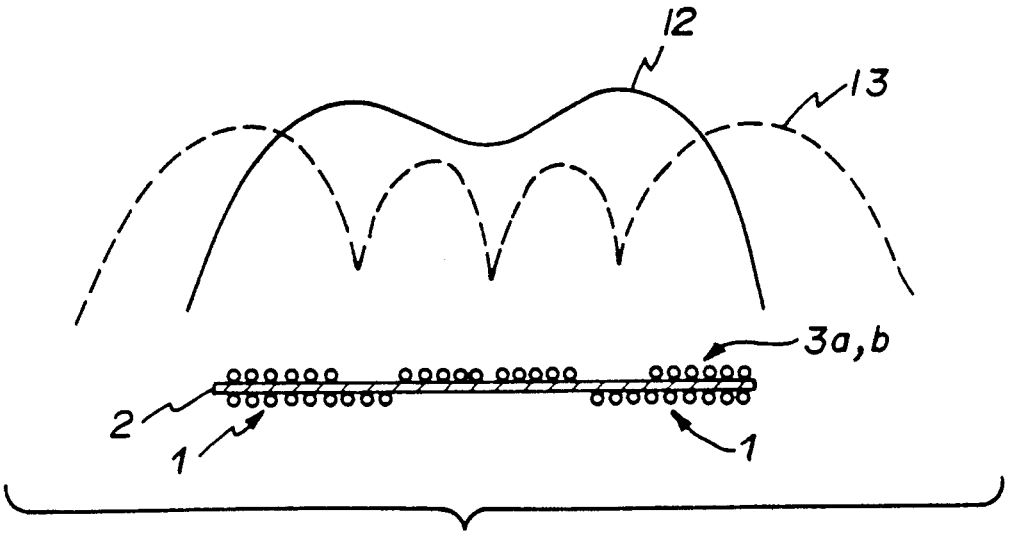
FIG. 7 is a cross-sectional view of the card and coil assembly illustrated in FIGS. 1 and 2, with a diagrammatic representation of the sensitivity of the coil assembly.

The symmetrical overlay of the generator coil 1 and two detector coils 3*a*, 3*b* on card 2 is best seen in the cross-sectional view of FIG. 7. The sensitivity of the coil assembly which results from the coil configuration is also shown therein. Solid line 12 represents the sensitivity to a lavel 4 (FIG. 3) oriented vertically, as a function of label position with respect to the coil assembly. Dotted line 13 similarly represents the sensitivity to a label 4 oriented horizontally.

I claim:

1. An interrogating system for use in an anti-pilferage system, wherein the interrogating system comprises a magnetic field generator which is in the form of a substantially planar spirally wound coil, and means for detecting the response of a magnetic tag positioned within the effective field generated by said magnetic field generator, said detection means comprising one or more pairs of coils wound spirally and positioned so as to overlay the magnetic field generator coil.

2. A system as claimed in claim 1 in which said overlay is exactly symmetrical and the phasing of the windings is such that the net signal coupled directly from the field generator coil is near to zero.

3. A systems as claimed in claim 1 in which the magnetic field generator coil and/or the coils of the detection means are formed by photolithographic techniques.

4. A system as claimed in claim 1 which is constructed as an array of such coils and which, in use, is positioned close to a point of sale such that customers and/or items to be checked will pass close to the array.

5. A system as claimed in claim 1 which comprises a hand-held unit based on a single coil assembly of magnetic field generator coil and coils of the detection means.

* * * * *